US006749476B2

(12) United States Patent
Chang

(10) Patent No.: US 6,749,476 B2
(45) Date of Patent: Jun. 15, 2004

(54) FIELD EMISSION DISPLAY CATHODE (FED) PLATE WITH AN INTERNAL VIA AND THE FABRICATION METHOD FOR THE CATHODE PLATE

(75) Inventor: Chih-Chin Chang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 73 days.

(21) Appl. No.: 09/986,175

(22) Filed: Nov. 7, 2001

(65) Prior Publication Data

US 2002/0105261 A1 Aug. 8, 2002

Related U.S. Application Data

(62) Division of application No. 09/855,711, filed on May 16, 2001, now abandoned.

(30) Foreign Application Priority Data

Feb. 6, 2001 (TW) ..... 90102470 A

(51) Int. Cl.[7] ..... H01J 9/24; H01J 63/04

(52) U.S. Cl. ..... 445/24; 445/25; 313/495

(58) Field of Search ..... 445/24, 25; 313/495, 313/496, 497, 310, 311, 351, 326, 309, 336, 346 R; 257/10

(56) References Cited

U.S. PATENT DOCUMENTS 5,277,638 A * 1/1994 Lee ..... 445/24
5,461,009 A * 10/1995 Huang et al. ..... 216/11
5,509,839 A * 4/1996 Liu ..... 445/24
5,543,686 A * 8/1996 Huang et al. ..... 313/497
5,621,272 A * 4/1997 Levine et al. ..... 313/422
5,663,608 A * 9/1997 Jones et al. ..... 313/309
5,683,282 A * 11/1997 Liu et al. ..... 445/24
5,686,790 A * 11/1997 Curtin et al. ..... 313/493
5,723,052 A * 3/1998 Liu ..... 216/25
5,772,485 A * 6/1998 Jeng et al. ..... 445/24
5,820,433 A * 10/1998 Liu et al. ..... 445/24
5,886,460 A * 3/1999 Jones et al. ..... 313/310
5,893,787 A * 4/1999 Chan et al. ..... 445/24
6,000,980 A * 12/1999 Baldi et al. ..... 445/24
6,045,425 A * 4/2000 Bothra et al. ..... 445/24
6,062,931 A * 5/2000 Chuang et al. ..... 445/24
6,133,678 A * 10/2000 Kishino et al. ..... 313/309
6,218,778 B1 * 4/2001 Tomita et al. ..... 313/495
6,425,791 B1 * 7/2002 Raina et al. ..... 445/24

* cited by examiner

*Primary Examiner*—Dean Reichard
*Assistant Examiner*—Angel R. Estrada
(74) *Attorney, Agent, or Firm*—Intellectual Property Solutions, Incorporated

(57) ABSTRACT an FED cathode plate with internal via includes an internal via; a second dielectric layer; a second gate line; a metal layer 12 covering the gate line and the internal via; and a contact. The internal via is located on a typical tape line. The second dielectric layer is located on the tape line and abutted against the internal via, thereby connecting to an anode by an adhesive. The second gate line is located on the second dielectric layer and abutted against the internal via. The metal layer is covered over the first gate line, the internal via, and the second gate line; and the contact is located on the tape line and connected adjacent to the second dielectric layer, thereby electrically connecting a lead to outside.

10 Claims, 11 Drawing Sheets

| Comparison | Original | | Novel | |
|---|---|---|---|---|
| layer 1 | Nb: | Column | Nb: | Column+Tape Line |
| layer 2 | Resister(Si): | Resistive Layer | Resister(Si): | Resistive Layer |
| layer 3 | Cr: | Tape Line | Hole: | Microtip Cavity+Via+Contact |
| layer 4 | Hole: | Microtip Cavity | Line: | Gate Line |
| layer 5 | Line: | Gate Line | | |
| layer 6 | Contact: | Contact | | |

FIG. 5

FIELD EMISSION DISPLAY CATHODE (FED) PLATE WITH AN INTERNAL VIA AND THE FABRICATION METHOD FOR THE CATHODE PLATE

This application is a division of prior application Ser. No. 09/855,711 filed May 16, 2001, now abandoned.

BACKGROUND OF THE INVENTION

1. Field of the Invention

The invention relates to an FED structure, particularly to an FED cathode plate with an internal via and the fabrication method for the cathode plate, which uses the vaporization to form the internal via such that the cathode sealing area of FED appears homogeneous, thereby increasing the yield.

2. Description of the Related Art

FIG. 1 is a schematic diagram of a typical FED cathode plate. In FIG. 1, the FED cathode plate is generally formed by layers successively deposited onto a substrate 10. The layers include a resistive layer 11, a cathode conductor layer 13, a microtip 2, a microtip cavity 3, a microtip hole 4, a gate line 5, a contact 7, a dielectric layer 16, a tape line 18, a seal 8, and an anode plate 9.

As shown in FIG. 1, in such a structure, the FED emits electrons induced by the electrical field of the gate line 5 from the microtip 2 through the hole 4. The emitted electrons are conducted and sped up by the anode plate 9 and impact the fluorescent powder (not shown) distributed on the surface of the anode plate 9. Thus, fluorescent light is emitted. The light can pass through the anode 9 and present on the back of the anode 9 (i.e. display plate (not shown)) to display an image. The operation principle of the FED is generally similar to a Cathode Ray Tube (CRT), except that the FED can be produced in a thin flat panel display.

A typical FED cathode plate is prepared through 6 photolithography, 6 etchings, and 6 thin film processes. Like numbers refer to like components in all drawings. FIG. 2 is a diagram of the fabrication steps of FIG. 1. In FIG. 2, the steps include deposition, etching, evaporation, and lift-off. As shown in FIG. 2, the FED cathode plate is successively deposited onto a substrate 10 to constitute the layers having a microtip hole 4 on the top, as shown in FIG. 2*a*. As shown in FIG. 2*b*, the dielectric layer 16 is etched to form the microtip cavity 3 about 2 $\mu$m wide, using dry and wet etching. As shown in FIG. 2*c*, graze evaporation is used on the plate with a slope of 20° to form an aluminium conductor layer 19. As shown in FIG. 2*d*, the evaporation is used in the plate with a vertical position like the arrow shown to form the microtip 2 within the microtip cavity 3. As shown in FIG. 2*e*, the phosphoric acid solution is used to lift off excessive deposition, including the layer 19, and only leave the microtip 2 within the cavity 3. Thus, a typical cathode plate is completed. Further, a glass frit is used to join the cathode plate to the anode plate 9 which are then sealed to form an electrode in vacuum.

The sealing area of the electrode is located around the light-emitting region of the display (FIG. 1). The sealing prevents outside air from diffusing into the display, thus ensuring the integrity of the display's vacuum. The glass frit, however, has a tendency toward corruption. Accordingly, chromium (Cr) is used in the passages (i.e. tape line 18) of the two lateral edges through which the glass frit passes. Although the chromium can prevent corruption from the glass frit, the adhesion difference between chromium and the $SiO_2$ composing the dielectric layer 16 can easily cause splits in the edge of the structure during durability testing of the product, compromising the vacuum inside the display. In such cases, the display provides uneven illumination and a friable structure in the sealed area, thus reducing the yield. As well, the hole 4 is small, about 1 $\mu$m, and the efficient depth of focus (DOF) for photolithography is low, so that exposure uniformity may be insufficient, further causing stepper shots' marks, reducing the yield of the cathode plate.

SUMMARY OF THE INVENTION

Accordingly, an object of the invention is to provide an FED cathode plate with an internal via, which prevents diffusion of outside air from corrupting the vacuum inside, thus increasing the evenness and durability of the FED frame.

Another object of the invention is to provide a fabrication method for the FED cathode plate with an internal via, which uses the internal via and improves the processes, thereby reducing the cycle, the limit, and the cost in the processes.

The invention is an FED cathode plate with an internal via and the fabrication method for the FED cathode plate. The FED cathode plate with an internal via includes: a substrate; a resistive layer with a cathode conductor deposited over the substrate; a tape line located on the substrate and kept separate from the resistive layer; a first dielectric layer, located on the resistive layer and part of the tape line and having a microtip cavity to accommodate a microtip; a first gate line, located over the first dielectric layer and having a respective microtip hole of the microtip; an internal via, located on the tape line and abutted against the first dielectric layer and the gate line; a second dielectric layer, located on the tape line and abutted against the internal via, thereby connecting to an anode by an adhesive; a second gate line, located on the second dielectric layer and abutted against the internal via; a metal layer covering the first gate line, the internal via, and the second gate line; and a contact, located on the tape line and connected adjacent to the second dielectric layer, thereby electrically connecting a lead to the outside. The fabrication method includes the following steps: depositing an FED cathode structure from bottom to top including a substrate, a resistive layer, a dielectric layer, and a gate line; dry etching the cathode structure to form a cathode plate with the hole and cavity of a microtip, an internal via, and a contact; sloping the plate to a predetermined angle to form a metal layer by evaporation; forming a microtip within the microtip cavity by vertical layer evaporation; and lifting off the excessive deposition on the surface of the plate by immersing the plate in a chemical solution.

BRIEF DESCRIPTION OF THE DRAWINGS

The aforementioned objects, features and advantages of this invention will become apparent by referring to the following detailed description of a preferred embodiment with reference to the accompanying drawings, wherein:

FIG. 5 is a comparison table of the fabrication steps of FIGS. 2 and 4.

DETAILED DESCRIPTION OF THE INVENTION

Figure 1:
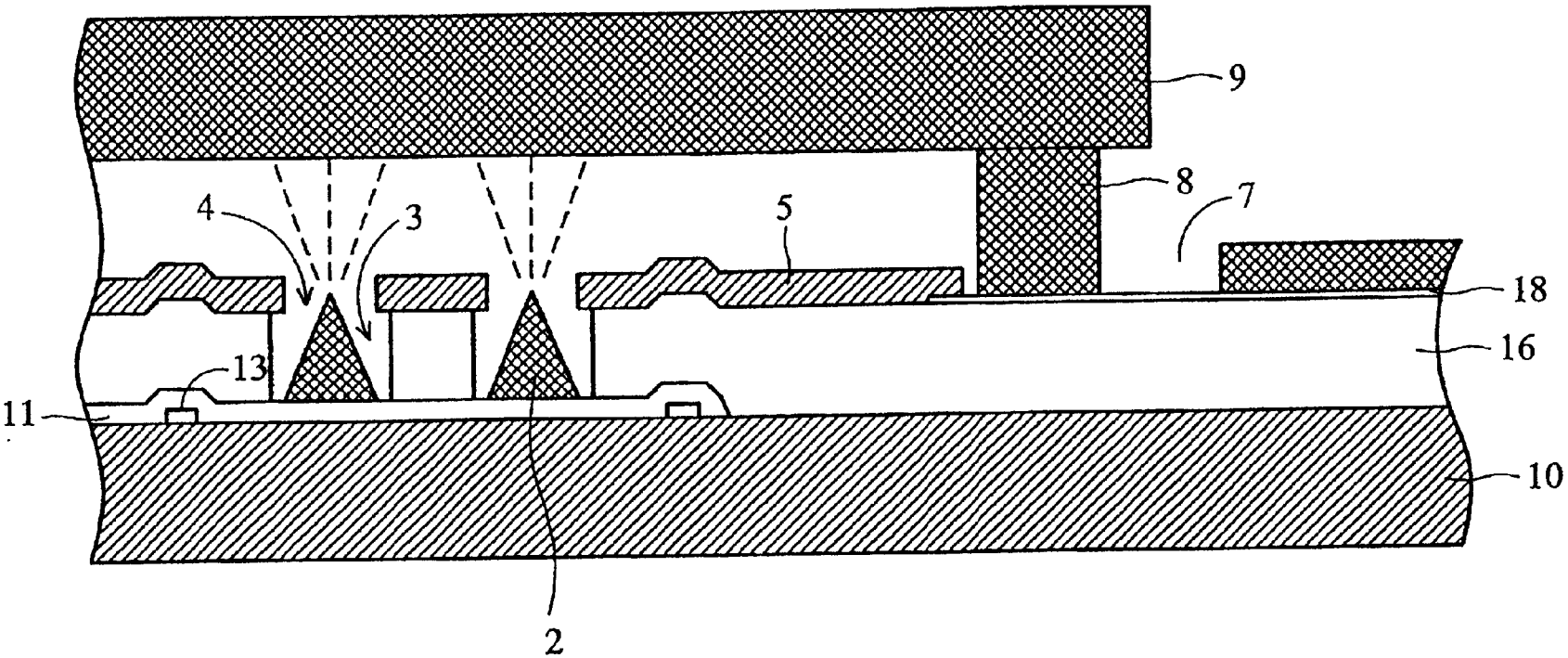
FIG. 1 ( PRIOR ART )
FIG. 1 is a schematic diagram of a typical FED cathode plate.
Figure 2A:
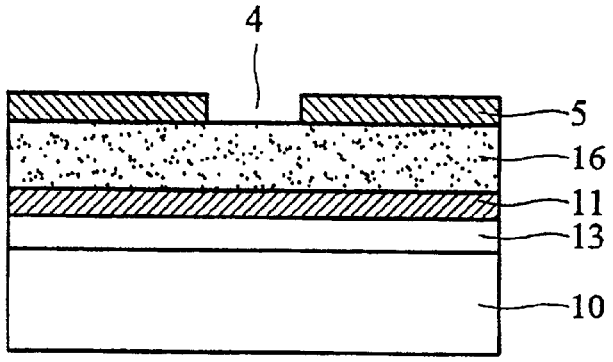
FIG. 2a ( PRIOR ART )
FIG. 2 is a diagram of the fabrication steps of FIG. 1.
Figure 2B:
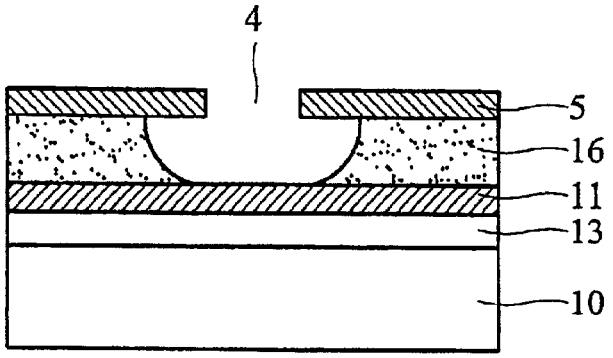
FIG. 2b ( PRIOR ART )
Figure 2C:
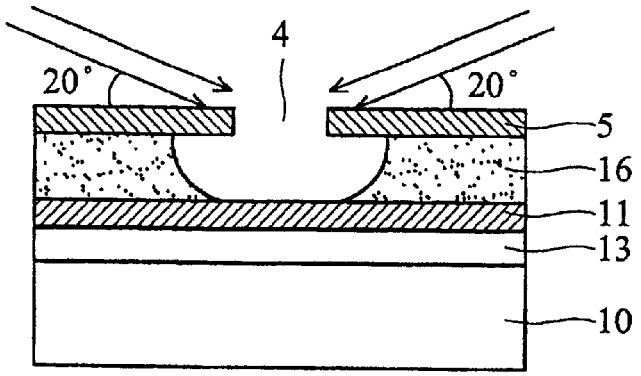
FIG. 2c ( PRIOR ART )
Figure 2D:
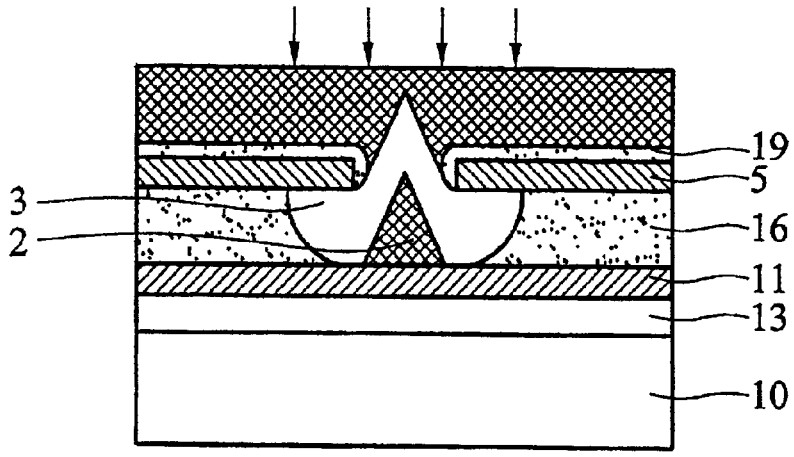
FIG. 2d ( PRIOR ART )
Figure 2E:
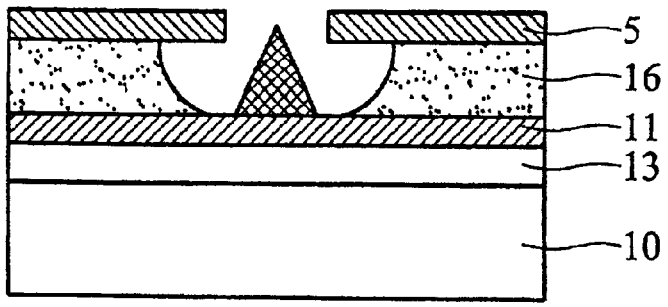
FIG. 2e ( PRIOR ART )
Figure 3:
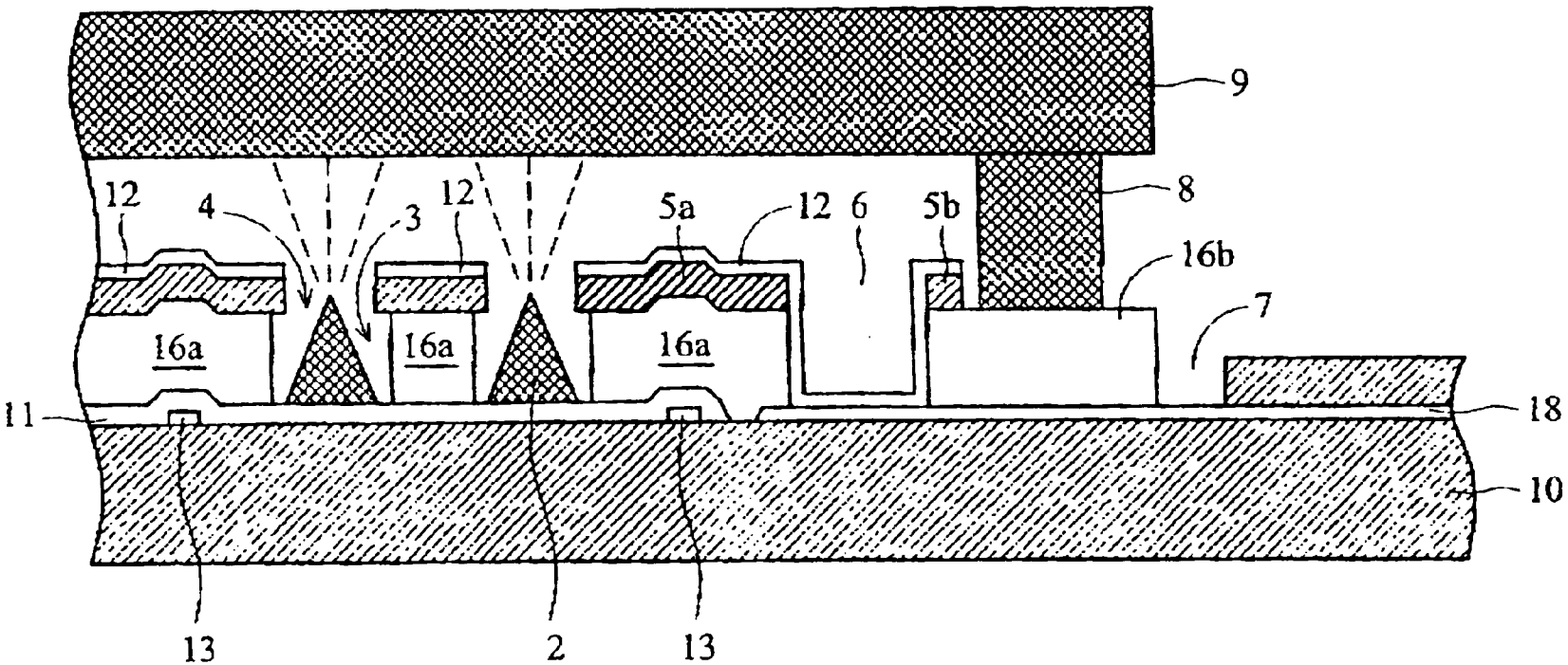
FIG. 3 is a schematic diagram of an FED cathode plate of the invention.

FIG. 3 is a schematic diagram of an FED cathode plate according to the invention. In FIG. 3, in addition to the typical FED structure, the structure also includes an internal via 6; a second dielectric layer 16*b*, a second gate line 5*b*, and a metal layer 12 covering the gate lines 5*a*, 5*b* and the internal via 6.

As shown in FIG. 3, the FED cathode plate with the internal via has a substrate 10 as the base of deposition. The material of the substrate 10 is glass. The resistive layer 11, a doped layer with a plurality of cathode conductors 13, is implemented over the substrate 10 to prevent a microtip 2 from being formed from excessive current. The material for the cathode conductors is niobium (Nb). The cathode conductors 13 are etched based on a column pattern to create a column line surrounding the cathode conductors 13. At the same time, the tape line 18 is formed on the substrate 10 maintaining a distance from the resistive layer 11. The tape line 18 is chromium (Cr). The tape line 18 is a thin film deposited along with the path from gate lines 5*a* and 5*b*, through a contact 7, bond wiring to a metal pad (not shown) outside. Next, the cathode is joined and sealed to the anode 9 with an adhesive 8, e.g. glass frit, thereby producing an electrode. The electrode interacts with the outside through the thin film 18. The first dielectric layer 16*a* formed of $SiO_2$ is located on the resistive layer 11 and part of the tape line 18 and has microtip cavities 3 to accommodate microtips 2. Dry etching the first dielectric layer 16*a* forms the cavity 3, about 2 $\mu$m wide. The first dielectric layer 16*a* acts as an insulator. The first gate line 5*a* is located on the first dielectric layer 16*a* in order to use the first dielectric layer 16*a* to prevent the first gate line 5*a* from directly contacting the cathode conductors 13. The material for the pate line is niobium (Nb). The first gate line 5*a* has a respective hole 4 located at the microtip 2. The hole 4 is deposited to be a diameter about 1.6 $\mu$m wide. The internal via 6 is located on the tape line 18 and abutted against the first dielectric layer 16*a* and the gate line 5*a*. The internal via 6 is formed by dry etching. The second dielectric layer 16*b* is located on the tape line and abutted against the internal via 6. The first dielectric layer 16*a* and the second dielectric layer 16*b* have the same height and is $SiO_2$. The adhesive 8, for example, glass frit, is used to connect the second dielectric layer 16*b* of the cathode to an anode 9. The second gate line 5*b* is located on the second dielectric layer 16*b* and abutted against the internal via 6. The first gate line 5*a* is the same height as the second gate line. The metal layer is covered over the first gate line 5*a*, the internal via 6, and the second gate line 5*b*. The metal layer 12 is about 2000 Å and is formed of niobium (Nb). The contact 7 is located on the tape line 18 and connected adjacent to the second dielectric layer 16*b*, thereby electrically connecting a lead (not shown) to the outside through the internal via 6 and the tape line 18.

When the adhesive (glass frit) 8 combines and seals with the anode 9, because the adhesive 8 erodes the Nb-including metal layer 12 on the second gate line 5*b*, a separate distance between the adhesive 8 and the metal 12 is necessary, as shown in FIG. 3.

Figure 4:
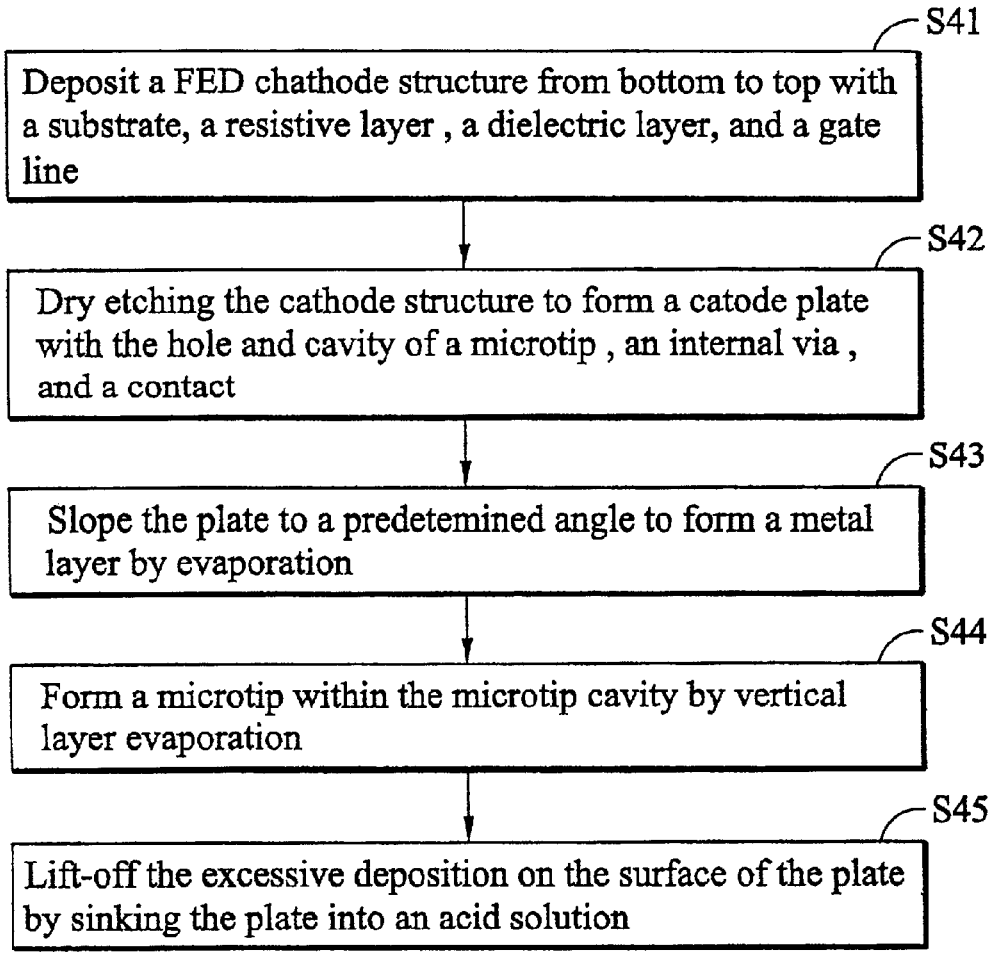
FIG. 4 is a diagram of the fabrication steps of FIG. 3.

FIG. 4 is a diagram of the fabrication steps of FIG. 3. In FIG. 4, The fabrication method includes the steps: depositiong an FED cathode structure (S41); dry etching the cathoke structure to form a cathode plate (S42); evaporation the plate with a predetermined slope angle (S43); forming a microtip by vertical layer evaporation (S44); and lifting off the excessive deposition by a solution (S45).

Figure 6A:
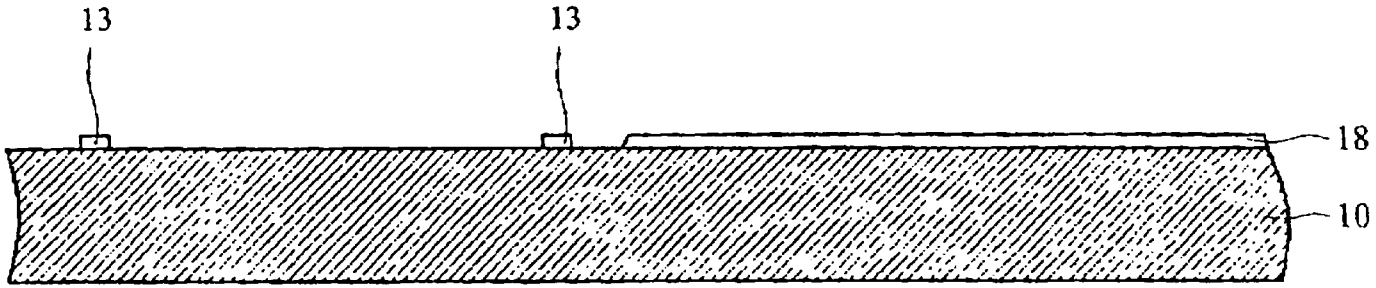
FIGS. 6*a* to 6*f* are cross sections of the manufacturing process for the FED cathode plate as shown in FIG. 3.
Figure 6B:
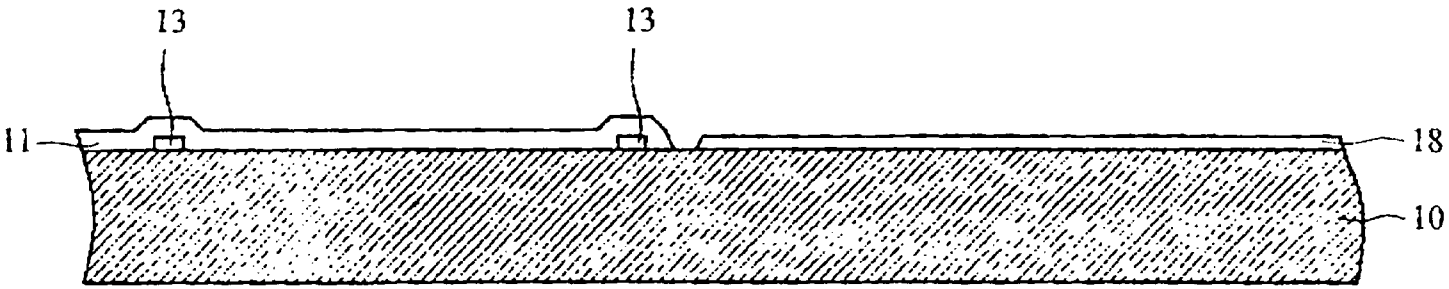
Figure 6C:
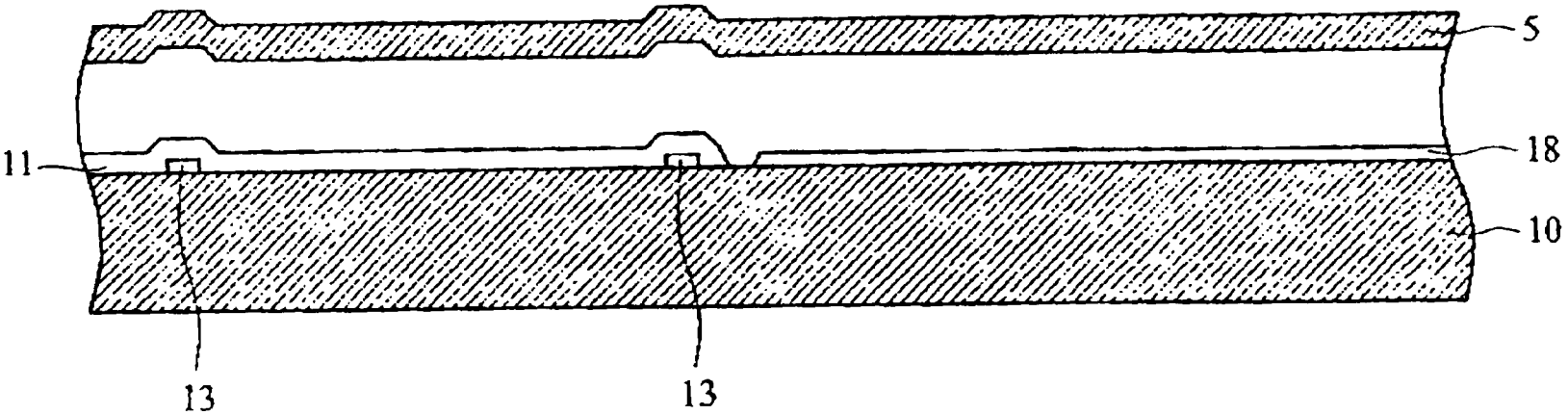
Figure 6D:
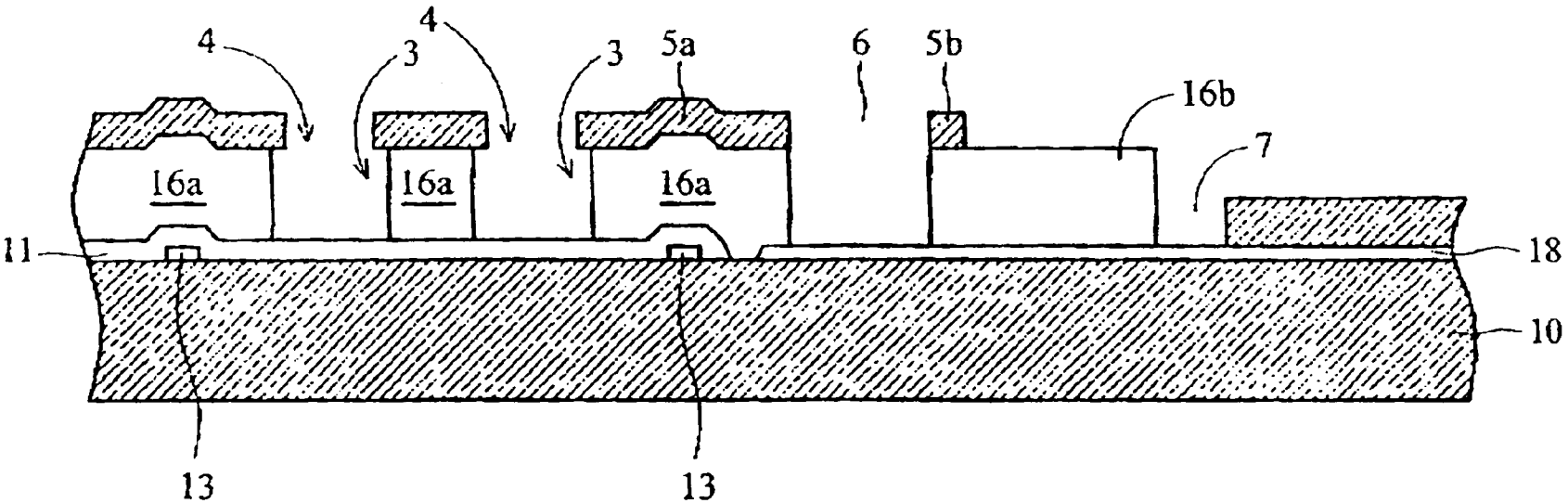
Figure 6E:
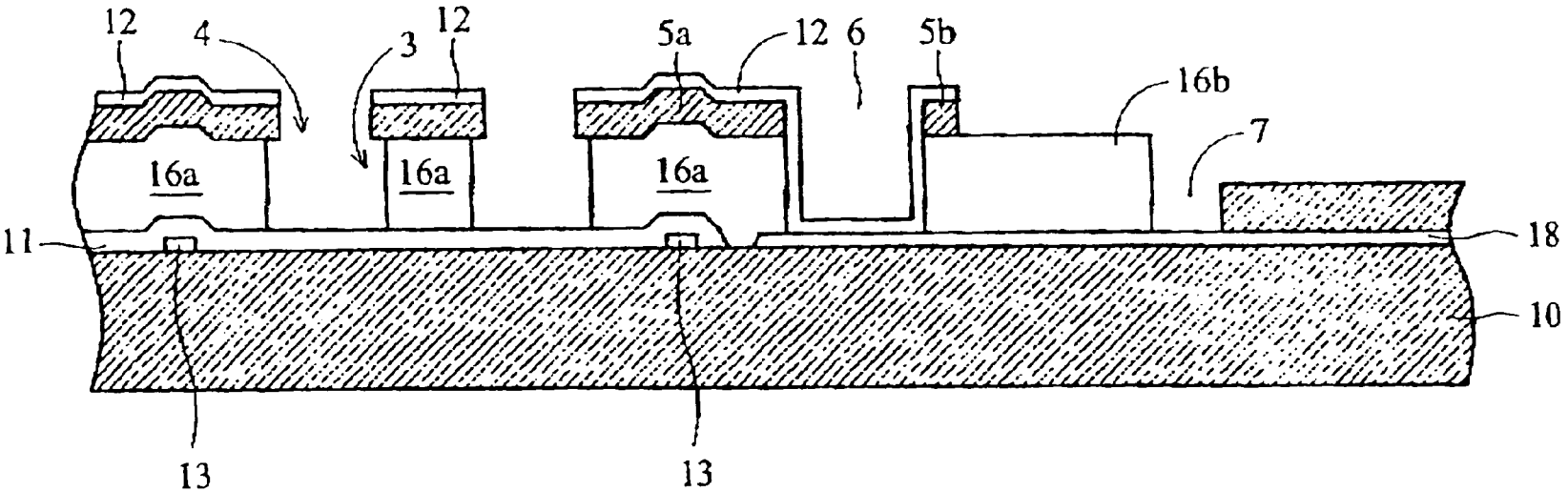
Figure 6F:
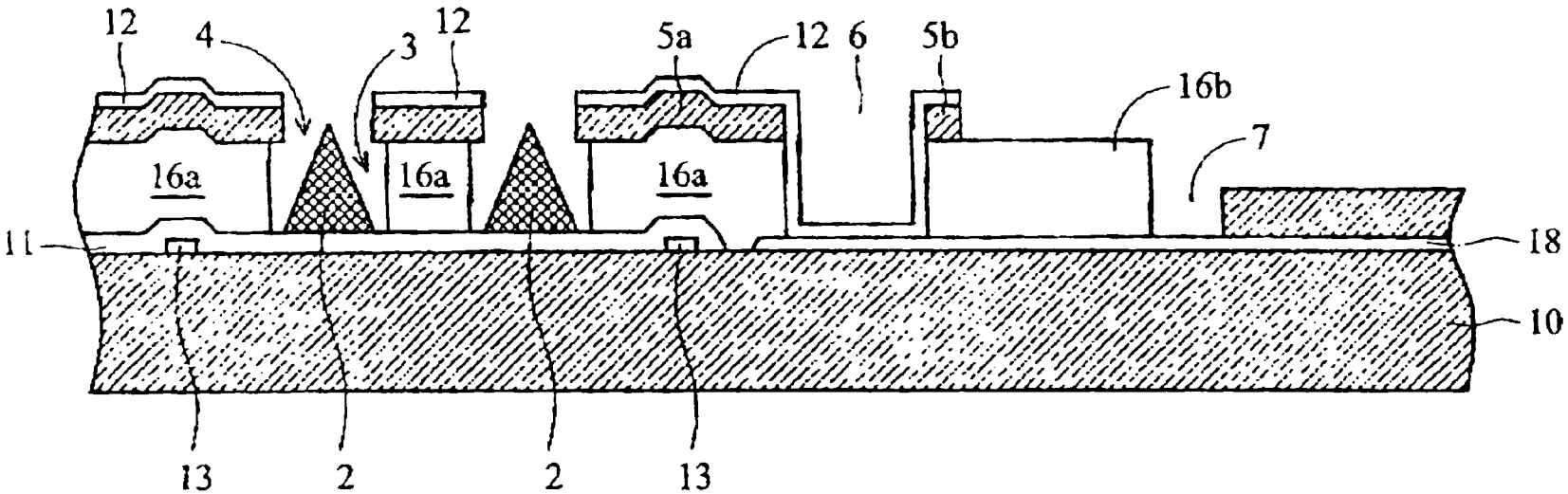

As shown in FIG. 4, in steps 341 and 342, the detail is shown in FIG. 5 that layers except for the substrate 10 are in the comparison table. FIGS. 6*a* to 6*f* are cross sections of the manufacturing process for the FED cathode plate as shown in FIG. 3. In FIG. 6*a*. for the novel part concurrently referring to FIG. 3, a layer such as an Nb-including metal layer is deposited to form a plurality of cathode conductors 13 and the tape line 18. In FIG. 6*b*, a resistive layer 11 is formed to cover the cathode conductors 13 and maintain a distance from the tape line 18. The resistive layer 11 is a doped-silicon resistive layer having the resistance function. In FIG. 6*c*, a dielectric layer 16 and a gate line 5 is formed on the resistive layer 11 and the tape line 18. In FIG. 6*d*, the dielectric layer 16 and a gate line 5 is etched to form a microtip cavity 3, a hole 4 an internal via 6, and a contact 7. Thus, the invention deposits a FED cathode structure from bottom to top including a substrate, a resistive layer, a dielectric layer and a gate line. Also, the intention uses dry etching in the cathode structure to form a cathode plate with the hole and the microtip cavity, an internal via, and a contact. In FIG. 6*e*, the plate is sloped to a predetermined angle in order to form a metal layer on the gate line and the internal via contacting with the tape line by evaporation. The predetermined angle is preferably between 10 and 30 degrees. The material for evaporation to form the metal layer is Nb, compared to Al in the prior art. In FIG. 6*f*, the plate is recovered in a horizontal direction with the face to be deposited downward, thereby forming a microtip 2 within the microtip cavity 3. The microtip 2 is molybdenum. Sequentially, excessive deposition on the surface of the plate is removed by solution, e.g. phosphoric acid and the Nb-including metal layer 12 and the microtip 2 are retained. Finally, referring to FIG. 3. the completed cathode plate is joined and sealed with the anode 9 by adhesive 8, e.g. glass frit. A FED is thus completed.

The invention, other than the 6 photolithography, 6 etchings, and 6 film processes in the prior art (see the original part of FIG. 5), only applies 4 photolithography, 4 etchings, and 5 film processes (the four layers of FIG. 5+substrate), when using the selected metal material. Therefore, required processes are reduced by about ⅓ from the prior art, reducing fabrication costs and cycle times, thereby reducing the likelihood of defect occurring. In the new process, the invention replaces the original tape line and dielectric layer (both in contact with the sealing area) with a single dielectric layer 16 (including 16*a* and 16*b*). Also, the internal via 6 connecting the gate line 5 (including 5*a* and 5*b*) to the metal line (not shown) of the sealing area of the plate edge is concurrently finished in the process of forming the microtip. Thus, the sealed interface of the dielectric layer 16 (for example, $SiO_2$) only exists with uniform adhesion on the surfaces of the two-side sealing areas of the cathode surface, so that splits around the sealed area of the FED edge are prevented. The inner FED maintains its high vacuum state. Moreover, the invention keeps the microtip cavity the same size as the prior art but increases the size of the microtip hole in deed such that the DOF of its photolithogpahy is increased, reducing the stepper's shot mark caused by defocus.

Although the present invention has been described in its preferred embodiment, it is not intended to limit the invention to the precise embodiment disclosed herein. Those who are skilled in this technology can still make various alterations and modifications without departing from the scope and spirit of this invention. Therefore, the scope of the present invention shall be defined and protected by the following claims and their equivalents.

What is claimed is:

1. A fabrication method for the Field Emission Display (FED) cathode plate with an internal via, comprising the steps:

forming and defining a plurality of cathode conductors and a tape line on a substrate at the same time;

depositing a resistive layer to cover the cathode conductors; sequentially forming a dielectric layer and a gate line on the resistive layer and the tape line;

etching the gate line and the dielectric layer to form a cathode plate with a cavity of microtip, a hole upon the cavity of mirotip, an internal via, and a contact;

sloping the plate to a predetermined angle to form a metal layer on the gate line and the internal via to contact with the tape line by evaporation, wherein the predetermined angle is ranged between 10 to 30 degrees;

forming a microtip within the microtip cavity by vertical layer evaporation; and lifting off the excessive deposition on the surface of the plate by immersing the plate in a chemical solution.

2. The fabrication method of claim 1, wherein glass is used to form the substrate.

3. The fabrication method of claim 1, wherein doped silicon is used to form the resistive layer.

4. The fabrication method of claim 1, wherein niobium-including metal is used to form the cathode conductor, the gate line, and the metal layer.

5. The fabrication method of claim 1, wherein chromium-including metal is used to form the tape line.

6. The fabrication method of claim 1, wherein $SiO_2$ is used to form the dielectric layer.

7. The fabrication method of claim 1, wherein molybdenum-including metal is used to form the microtip.

8. The fabrication method of claim 1, further comprising the step of joining and sealing the completed cathode plate to an anode with an adhesive.

9. The fabrication method of claim 1, wherein the adhesive is glass frit.

10. The fabrication method of claim 1, wherein the hole is about 1.6 $\mu$m wide.

* * * * *